United States Patent [19]

Duponteil

[11] Patent Number: 4,770,239

[45] Date of Patent: Sep. 13, 1988

[54] HEAT EXCHANGER

[75] Inventor: Gilbert Duponteil, Courbevoie, France

[73] Assignee: Struthers Wells, S.A., Paris, France

[21] Appl. No.: 50,156

[22] Filed: May 13, 1987

[30] Foreign Application Priority Data

May 21, 1986 [FR] France ..... 86 07193

[51] Int. Cl.[4] ..... F28F 19/00

[52] U.S. Cl. ..... 165/134.1; 165/160

[58] Field of Search ..... 165/134.1, 160

[56] References Cited

U.S. PATENT DOCUMENTS

| | | | |
|---|---|---|---|
| 2,145,877 | 2/1939 | Houdry | 165/134.1 X |
| 3,356,135 | 12/1967 | Sayre | 165/134.1 X |
| 3,610,329 | 10/1971 | Markert et al. | 165/134.1 X |
| 3,907,026 | 9/1975 | Mangus | 165/134.1 X |
| 4,336,770 | 6/1982 | Kaneko et al. | 165/160 X |
| 4,418,748 | 12/1983 | Pouderoux et al. | 165/134.1 |

FOREIGN PATENT DOCUMENTS

| | | | |
|---|---|---|---|
| 5453 | 1/1978 | Japan | 165/134.1 |

*Primary Examiner*—Ira S. Lazarus
*Assistant Examiner*—Peggy Neils
*Attorney, Agent, or Firm*—Kurt Kelman

[57] ABSTRACT

A heat exchanger comprises a cylinder and a bundle of heat exchange tubes passing through its interior heat exchange chamber for receiving a hot fluid to be cooled while circulating through the tubes from an inlet to an outlet end. A support for the bundle of heat exchange tubes at each cylinder end comprises a relatively thin, cylinder end closing plate to which respective ends of the heat exchange tubes are affixed, a much thicker, rigid plate affixed to the interior cylinder wall at a distance from the thin plate, the heat exchange tubes passing through bores in the thicker, rigid plate with a clearance, the thin plates and the much thicker, rigid plates defining heat exchange chamber compartments therebetween and another heat exchange chamber compartment extending between the thicker, rigid plates, and rigid tubular sections extending through the heat exchange chamber compartments and interconnecting the thin plate and the much thicker, rigid plate for bracing the plates, the rigid tubular sections concentrically surrounding the ends of the heat exchange tubes whereby annular spaces are defined between the rigid tubular sections and the heat exchange tube ends, the annular spaces being in communication with the clearances, and the rigid tubular sections defining orifices wherethrough the heat exchange chamber compartments communicate with the annular spaces.

6 Claims, 1 Drawing Sheet

HEAT EXCHANGER

Figure 1:
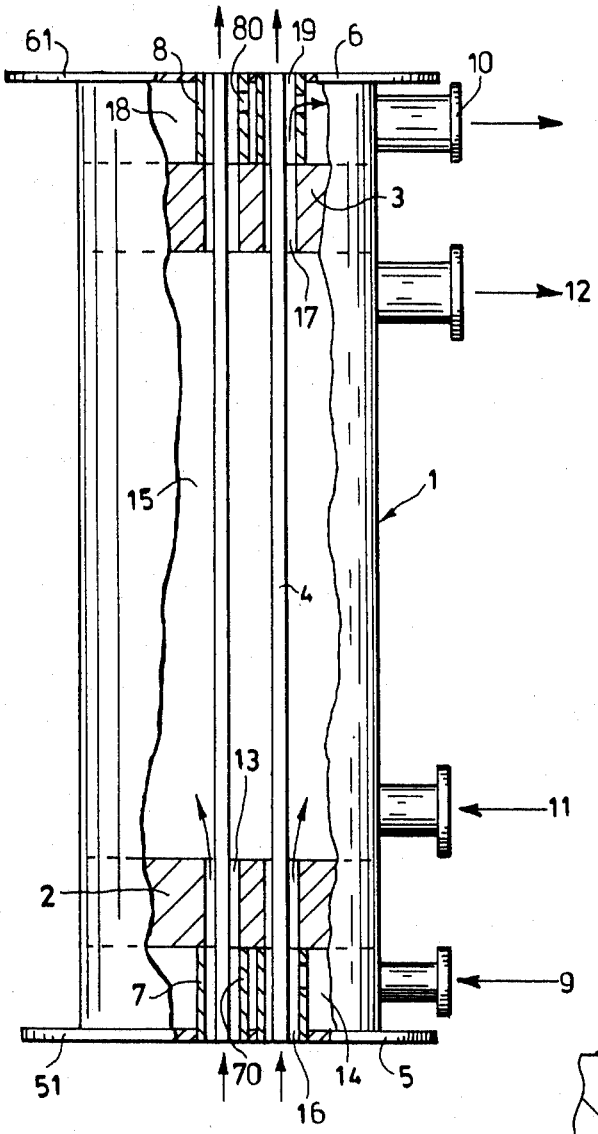

The present invention relates to a heat exchanger comprising a cylinder having an inlet end and an outlet end, an interior wall of the cylinder defining a heat exchange chamber in the cylinder between the inlet and outlet ends, a bundle of heat exchange tubes passing through the heat exchange chamber, and a support for the bundle of heat exchange tubes at each cylinder end. A hot fluid to be cooled circulates through the tubes from the inlet to the outlet end and is cooled in heat exchange by a cooling fluid circulating around the heat exchange tubes in the cylinder.

The difficulties in the construction of such heat exchangers grow with the temperature and the pressure of the gaseous fluid to be cooled, and with the pressure of the vapor of the cooling fluid, for example if the heat exchanger is used in a recuperating boiler. The composition of the gaseous fluid to be cooled may further increase such difficulties, for example in the cooling of corrosive synthesis gases produced at temperatures exceeding 450° C. and under high pressure. In such instances, there is a risk of corrosion and of mechanical weakening of the materials constituting the heat exchangers, and in an effort to reduce such risks, it is important to maintain the temperature of the heat exchange tubes at a substantially lower temperature, for example below 360° C.

In conventional heat exchangers of the indicated type, the plate constituting the support for the heat exchange tubes must also withstand the high evolving vapor pressure. Therefore, it must have a substantial thickness. Furthermore, the support plate at the inlet end of the cylinder, through which the heat exchange tubes pass, is strongly heated by heat exchange with the gas circulating through the heat exchange tubes and is subjected to considerable temperature gradients between the opposing end faces of the support plate. Substantial corrosive forces may also be present. For these reasons, it has been proposed to use special steels for making or, at least, cladding such support plates, which considerably increases the cost of manufacture and also adds to the weight.

It is the primary object of this invention to overcome these disadvantages by a novel support for the bundle of heat exchange tubes at least at the inlet end. This support comprises a relatively thin plate closing the inlet end of the cylinder, one of the ends of the heat exchange tubes being affixed to the thin cylinder inlet end closing plate, and a much thicker, rigid plate affixed to the interior cylinder wall at a distance from the thin plate, the heat exchange tubes passing through bores in the thicker, rigid plate with a clearance. The thin plate and the much thicker, rigid plate define a compartment of the heat exchange chamber therebetween and another heat exchange chamber compartment extends from the thicker, rigid plate towards the outlet end, and rigid tubular sections extend through the heat exchange chamber compartment and interconnect the thin plate and the much thicker, rigid plate for bracing the plates. Respective rigid tubular sections concentrically surround the one ends of respective heat exchange tubes whereby annular spaces are defined between the rigid tubular sections and the one ends of the heat exchange tubes, respective annular spaces being in communication with respective clearances, and the rigid tubular sections defining orifices wherethrough the heat exchange chamber compartment communicates with the annular spaces. An inlet conduit for a cooling fluid supplies the cooling fluid to the heat exchange chamber compartment whereby the cooling fluid is circulated through the orifices and in the annular spaces and the clearances around the heat exchange tubes for heat exchange between the hot fluid circulating in the heat exchange tubes and the cooling fluid circulating around the heat exchange tubes.

Preferably, the same support is provided at the outlet end of the cylinder.

Figure 2:
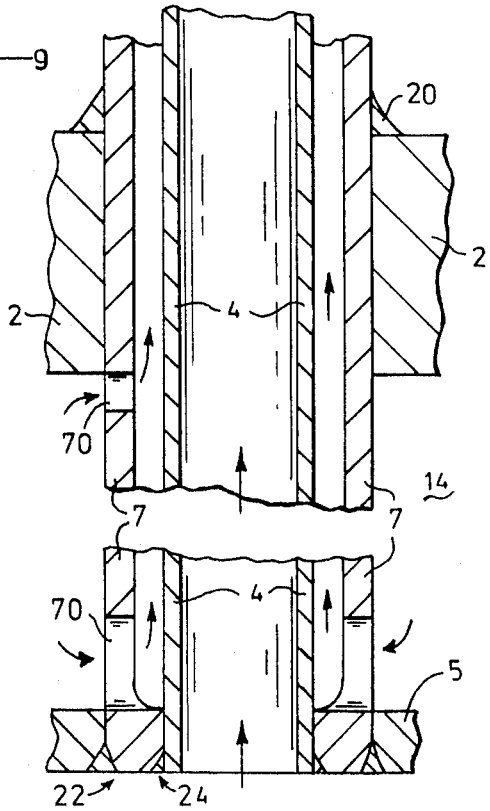

The above and other objects, advantages and features of the invention will be more fully described with reference to a now preferred embodiment thereof, taken in conjunction with the accompanying somewhat schematic drawing wherein FIG. 1 is a side elevational view of a heat exchanger according to the present invention, with a portion of the cylinder wall broken away to show the interior of the cylinder and the supports for the heat exchange tube ends shown in section; and FIG. 2 is a fragmentary enlarged view illustrating structural details of a modified support.

FIG. 1 shows a tubular heat exchanger comprising elongated cylinder 1 having an inlet end and an outlet end, the interior wall of the cylinder defining a heat exchange chamber in the cylinder between the inlet and outlet ends. A bundle of heat exchange tubes 4 pass through the heat exchange chamber for receiving a hot fluid, such as a hot gas, to be cooled while circulating through the tubes from the inlet to the outlet end, as indicated by vertically upwardly pointing arrows. In the illustrated embodiment, like supports are provided for the bundle of heat exchange tubes 4 at each cylinder end.

The support at the inlet end comprises relatively thin plate 5 closing the inlet end of cylinder 1, one of the ends of the heat exchange tubes being affixed to thin cylinder end closing plate 5, and much thicker, rigid plate 2 affixed to the interior cylinder wall at a distance from the thin plate, heat exchange tubes 4 passing through bores 13 in the thicker, rigid plate with a clearance. Thin plate 5 and much thicker, rigid plate 2 define compartment 14 of the heat exchange chamber therebetween and another heat exchange chamber compartment 15 extends from thicker, rigid plate 2 towards the outlet end. Rigid tubular sections 7 extend through heat exchange chamber compartment 14 and interconnect thin plate 5 and much thicker, rigid plate 2 for bracing the plates. Respective rigid tubular sections 7 concentrically surround the one ends of respective heat exchange tubes 4 whereby annular spaces 16 are defined between the rigid tubular sections and the one ends of the heat exchange tubes, respective annular spaces 16 being in communication with respective bores 13 in thicker, rigid plate 2. Rigid tubular sections 7 define orifices 70 wherethrough heat exchange chamber compartment 14 communicates with annular spaces 16.

Inlet conduit 9 for a cooling fluid, such as water, supplies the cooling fluid to heat exchange chamber compartment 14 whereby the cooling fluid is circulated through the orifices and in annular spaces 16 and the clearances around heat exchange tubes 4 for heat exchange between the hot fluid circulating in the heat exchange tubes and the cooling fluid circulating around the heat exchange tubes. The heat exchange further comprises supplementary inlet conduit 11 for the cooling fluid for supplying a supplemental amount of cooling fluid to other heat exchange chamber compartment 15.

As shown in FIG. 1, the support at the outlet end similarly comprises relatively thin plate 6 closing the outlet end of cylinder 1, an end of the heat exchange tubes opposite to the one end being affixed to thin cylinder end closing plate 6, and much thicker, rigid plate 3 affixed to the interior cylinder wall at a distance from the thin plate, heat exchange tubes 4 passing through bores 17 in the thicker, rigid plate with a clearance. Thin plate 6 and much thicker, rigid plate 3 define third compartment 18 of the heat exchange chamber therebetween and the other heat exchange chamber compartment 15 extends between thicker, rigid plates 2 and 3. Rigid tubular sections 8 extend through heat exchange chamber compartment 18 and interconnect thin plate 6 and much thicker, rigid plate 3 for bracing the plates. Respective rigid tubular sections 8 concentrically surround the opposite ends of respective heat exchange tubes 4 whereby annular spaces 19 are defined between the rigid tubular sections and the opposite ends of the heat exchange tubes, respective annular spaces 19 being in communication with respective bores 17 in thicker, rigid plate 3. Rigid tubular sections 8 define orifices 80 wherethrough heat exchange chamber compartment 18 communicates with annular spaces 19.

Outlet conduit 10 for the cooling fluid removes the cooling fluid from heat exchange chamber compartment 18 and supplementary outlet conduit 12 removes cooling fluid from other heat exchange chamber compartment 15.

FIG. 2 shows structural details of a modified support for the bundle of heat exchange tubes at the inlet end, the support at the outlet end being identical. As illustrated, rigid tubular sections 7 extend through heat exchange chamber compartment 14 and interconnect thin plate 5 and much thicker, rigid plate 2, the rigid tubular sections passing through the bores in the thicker, rigid plate and having their ends respectively affixed to thicker, rigid plate 2 by annular welded or soldered joint 20 and to thin plate 5 by annular welded or soldered joint 22. In this case, annular space 16 is extended to define the clearance between heat exchange tube 4 and thicker, rigid plate 2. The one end of heat exchange tube 4 is affixed to thin plate 5 by annular joint 24 welding or soldering the heat exchange tube end to the adjacent end of rigid tubular section 7. Obviously, other means may be used for affixing the rigid tubular sections and the heat exchange tube ends to support plates 2 and 5, respectively.

Support plates 2 and 3 have a substantial thickness, for example of the order of 10 inches and, at any rate, sufficient to withstand the heat created by the fluid pressure inside cylinder 1. Support plates 5 and 6, on the other hand, have a thickness of the order of about 0.4 to 0.8 of an inch and, at any rate, sufficient to support heat exchange tubes 5 soldered or welded thereto. The diameter of heat exchange cylinder 1 may be of the order of 36 inches, for example. The distance between the thin support plate and the much thicker, rigid support plate at each cylinder end may be of the order of about 6 inches, for example. The annular space 16 between rigid tubular sections 7 and heat exchange tubes 4 may be of the order of about 0.1 to 0.4 of an inch, for example. Inlet conduit 9 supplies the cooling fluid into heat exchange chamber compartment 14 and its circulation through orifices 70 into annular space 16 is assured by a pump supplying the cooling fluid under pressure or by a thermosiphon effect.

Thin cylinder end closing plates 5 and 6 comprise peripheral mounting flanges 51 and 61.

In this illustrated embodiment, cylinder 1 is erect, i.e. its axis extends vertically. The gaseous fluid to be cooled as it circulates through heat exchange tubes 4 enters the one end of the heat exchange tubes at the level of thin support plate 5 which is heated by the hot incoming gaseous fluid through heat exchange. The cooling fluid, i.e. water, entering heat exchange chamber compartment 14 through inlet conduit 9 is vaporized through heat exchange with heated support plate 5 and hot heat exchange tubes 4. The water vapor enters annular spaces 16 through orifices 70 and a mixed liquid-vapor cooling fluid phase surrounds the heat exchange tubes and cools them through heat exchange.

The support structure at the upper, outlet end of cylinder 1 is the same as at the lower, inlet end. The cooled gaseous fluids in heat exchange tubes 4 leaves the opposite ends of the heat exchange tubes at the level of thin support plate 6 while the heated mixed liquid-vapor cooling fluid circulating through intermediate heat exchange chamber compartment 15, clearances 17 and annular spaces 19 passes through orifices 80 and leaves heat exchange chamber compartment 18 through outlet conduit 10.

In the illustrated embodiment, supplementary inlet conduit 11 supplies a supplemental amount of cooling fluid to heat exchange chamber compartment 15 and some of the heated mixed liquid-vapor cooling fluid is evacuated through supplementary outlet conduit 12. In this way, only a sufficient amount of cooling fluid to cool heat exchange compartment 14 and the portion of heat exchange tubes 4 passing through this compartment and up to the upper end face of support plate 2 need be supplied through inlet conduit 9, and only an amount of the heated mixed liquid-vapor cooling fluid is evacuated through outlet conduit 10 which has not been removed through supplementary outlet conduit 12. The cooling fluid required to cool heat exchange tubes 4 in heat exchange chamber compartment 15 is supplied through supplementary inlet conduit 11.

It will be noted that the heat exchange tube supports described hereinabove are capable of withstanding very high pressures of the order of 100 to 150 bars, for example, due to the bracing between the two plates, without substantial deformation of the thin plates. Slight flexing of the thin support plates can only occur in the zone between the tube ends and will have no detrimental effects. At the same time, the thinness of these plates assures that they will remain at a relatively low temperature.

Support plates 2, 3 are not subjected to temperature gradients between their two end faces, the mixed liquid-vapor cooling fluid, which may reach a temperature of about 300° C. to 350° C., equally heating both end faces and no contact existing between these plates and heat exchange tubes 4 through which the gaseous fluid to be cooled circulates at an initial temperature which may reach 600° C. to 1100° C. and at high pressures up to about 200 bars, for example.

Heat exchange tubes 4 are cooled along their entire length, including the passage across the thin support plates, and risk of corrosion or mechanical weakening due to the composition and/or the temperature of the gaseous fluid in the heat exchange tubes is substantially eliminated. Obviously, the problems arising from temperature gradients and corrosion are more serious at the inlet end than the outlet end. Therefore, the support structure of the present invention is more important at the inlet end than at the outlet end. Accordingly, a conventional support for the opposite heat exchange tube ends at the outlet end may replace the illustrated support in certain cases.

It will be understood that various modifications may occur to those skilled in the art after benefitting from this disclosure and without departing from the spirit and scope of this invention as defined in the appended claims.

What is claimed is:

1. A heat exchanger comprising (a) a cylinder having an inlet end and an outlet end,
  (1) an interior wall of the cylinder defining a heat exchange chamber in the cylinder between the inlet and outlet ends, (b) a bundle of heat exchange tubes passing through the heat exchange chamber for receiving a hot fluid to be cooled while circulating through the tubes from the inlet to the outlet end, (c) a support for the bundle of heat exchange tubes at each of said cylinder ends, at least the support at the inlet end comprising
  (1) a relatively thin plate closing the inlet end of the cylinder, one of the ends of the heat exchange tubes being affixed to the thin cylinder inlet end closing plate, and
  (2) a much thicker, rigid plate affixed to the interior cylinder wall at a distance from the thin plate, the heat exchange tubes passing through bores in the thicker, rigid plate with a clearance,
  (3) the thin plate and the much thicker, rigid plate defining a first compartment of the heat exchange chamber therebetween and a second heat exchange chamber compartment extending from the thicker, rigid plate towards the outlet end, and
  (4) rigid tubular sections extending through the first heat exchange chamber compartment and interconnecting the thin plate and the much thicker, rigid plate for bracing the plates, respective ones of the rigid tubular sections concentrically surrounding the one ends of respective ones of the heat exchange tubes whereby annular spaces are defined between the rigid tubular sections and the one ends of the heat exchange tubes, respective ones of the annular spaces being in communication with respective ones of the clearances, and the rigid tubular sections defining orifices wherethrough the first heat exchange chamber compartment communicates with the annular spaces, and (d) an inlet conduit for a cooling fluid for supplying the cooling fluid to the first heat exchange chamber compartment whereby the cooling fluid is circulated through the orifices and in the annular spaces and the clearances around the heat exchange tubes for heat exchange between the hot fluid circulating in the heat exchange tubes and the cooling fluid circulating around the heat exchange tubes.

2. The heat exchanger of claim 1, further comprising a supplementary inlet conduit for the cooling fluid for supplying the cooling fluid to the second heat exchange chamber compartment.

3. The heat exchanger of claim 1, wherein the support at the outlet end comprises (a) a relatively thin plate closing the outlet end of the cylinder, an end of the heat exchange tubes opposite to the one end being affixed to the thin cylinder outlet end closing plate, and (b) a much thicker, rigid plate affixed to the interior cylinder wall at a distance from the thin plate, the heat exchange tubes passing through bores in the thicker, rigid plate with a clearance, (c) the thin plate and the much thicker, rigid plate at the outlet end defining a third compartment of the heat exchange chamber therebetween, the second heat exchange chamber compartment extending between the two thicker, rigid plates, and (d) rigid tubular sections extending through the third heat exchange chamber compartment and interconnecting the thin plate and the much thicker, rigid plate for bracing the plates, respective ones of the rigid tubular sections concentrically surrounding the opposite ends of respective ones of the heat exchange tubes whereby annular spaces are defined between the rigid tubular sections and the opposite ends of the heat exchange tubes, respective ones of the annular spaces being in communication with respective ones of the clearances, and the rigid tubular sections defining orifices wherethrough the third heat exchange chamber compartment communicates with the annular spaces, (e) an outlet conduit for the cooling fluid for removing the cooling fluid from the third heat exchange chamber compartment, and (f) a supplementary outlet conduit for the cooling fluid for removing the cooling fluid from the second heat exchange chamber compartment.

4. The heat exchanger of claim 3, wherein the thin cylinder end closing plates comprise a peripheral mounting flange.

5. The heat exchange of claim 4, wherein said rigid tubular sections extend through said bores in the thicker, rigid plate, and said annular spaces are extended to define said clearances.

6. The heat exchange of claim 1, wherein said rigid tubular sections extend through said bores in the thicker, rigid plate, and said annular spaces are extended to define said clearances.

* * * * *